United States Patent [19]

McCartherens

[11] Patent Number: 4,953,998

[45] Date of Patent: Sep. 4, 1990

[54] POLISHING GLOVE APPARATUS

[76] Inventor: Stone W. McCartherens, 916 Cedar Ave., Albany, Ga. 31701

[21] Appl. No.: 374,029

[22] Filed: Jun. 30, 1989

[51] Int. Cl.[5] ..... A46B 5/04; A47K 7/02; A47L 1/08; A47L 13/18

[52] U.S. Cl. ..... 401/7; 401/130; 15/227

[58] Field of Search ..... 2/160, 161; 15/227; 401/7, 8, 130, 42, 43, 40, 41, 45, 46, 47

[56] References Cited

U.S. PATENT DOCUMENTS

| | | | |
|---|---|---|---|
| 863,181 | 11/1906 | Cray | 15/227 |
| 1,359,985 | 11/1920 | Gromer | 401/7 |
| 1,538,961 | 5/1925 | Torbert | 401/8 |
| 2,405,154 | 8/1946 | Logan | 15/227 |
| 2,658,219 | 11/1953 | Torbert | 401/8 |
| 2,663,890 | 12/1953 | Sullins | 401/7 |
| 2,669,739 | 2/1954 | Winberg | 401/7 |
| 2,831,206 | 4/1958 | Curtis | 15/227 |
| 3,701,604 | 10/1972 | Holroyd | 401/7 |
| 3,748,792 | 7/1973 | Lamb | 51/391 |
| 3,883,897 | 5/1975 | Lefkowitz et al. | 2/161 R |
| 3,885,249 | 5/1975 | DeBrabander | 2/161 R |
| 4,670,930 | 6/1987 | Lu | 15/118 |
| 4,696,593 | 9/1987 | Baylors | 15/227 |

FOREIGN PATENT DOCUMENTS

| | | | |
|---|---|---|---|
| 1135018 | 12/1956 | France | 401/7 |

*Primary Examiner*—Danton D. DeMille

*Attorney, Agent, or Firm*—Henderson & Sturm

[57] ABSTRACT

A polishing glove apparatus (10) including a glove unit (11) equipped with a fluid reservoir unit which is operably connected to a fluid conduit (20) having a fluid control member (21) to selectively deliver liquid polish to a polishing cloth unit (14) which is releasably secured to the glove unit (11).

1 Claim, 1 Drawing Sheet

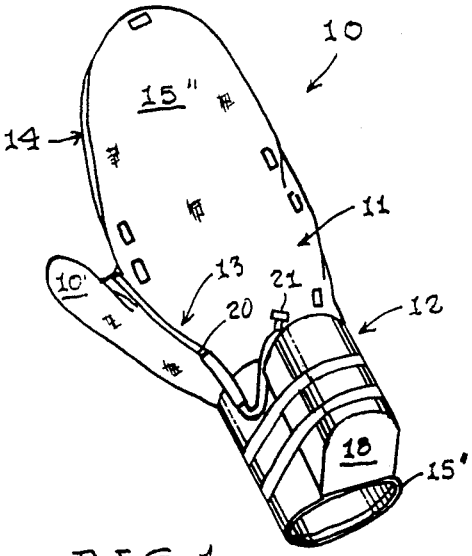
FIG. 1.
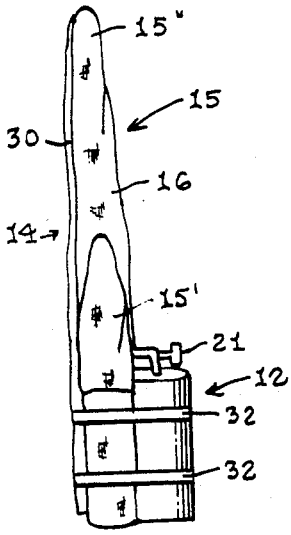
FIG. 2.
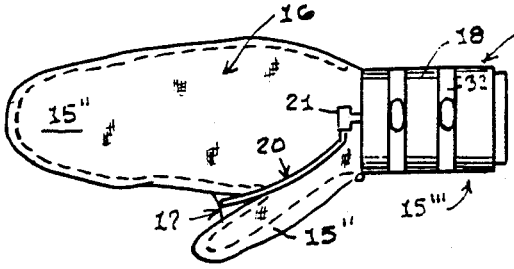
FIG. 3.
FIG. 5.
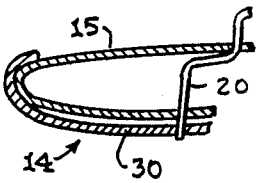
FIG. 4.
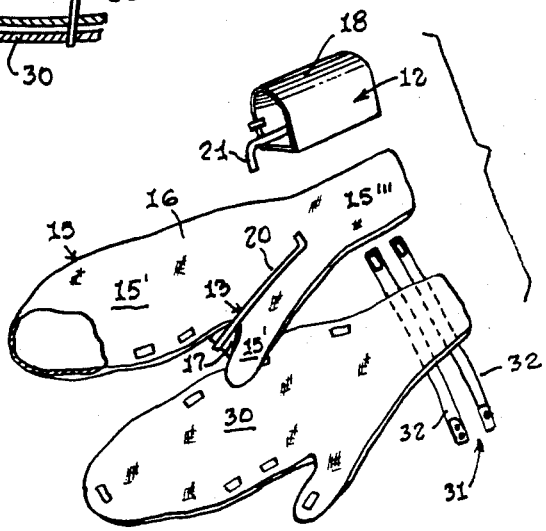

POLISHING GLOVE APPARATUS

TECHNICAL FIELD

The present invention relates generally to the field of reservoir equipped fluid delivery systems and more particularly to a polishing glove that carries its own supply of liquid polish and a delivery system to dispense the polish.

BACKGROUND OF THE INVENTION

The present invention was the subject matter of Document Disclosure Program No. 196075 which was filed in the U.S. Patent and Trademark Office on July 1, 1988.

As can be seen by reference to the following U.S. Pat. Nos. 3,833,897; 3,885,249; 4,670,930; and 3,748,792 the prior art is replete with myriad and diverse specialized glove constructions including at least one arrangement wherein the glove is equipped with a self contained fluid supply As anyone who has polished a great deal of furniture can inform you, one of the most vexing problems associated with this task is the time and effort that is expended in keeping tabs on the last location of the furniture polish coupled with the repeated application of the liquid polish to the surface of the polishing cloth.

As a consequence of the foregoing situation there has existed a long standing need among the general public for a specialized polishing glove construction that not only carries its own supply of polishing fluid; but, which also is equipped with means to selectively meter the amount of fluid that is delivered to the polishing material and/or surface to be polished; the provision of such a device being a stated objective of this invention.

SUMMARY OF THE INVENTION

Briefly stated the polishing glove apparatus of this invention comprises in general: a glove unit; a fluid reservoir unit; a fluid delivery unit; and, a polishing cloth unit.

As will be explained in greater detail further on in the specification the glove unit comprises a liquid impervious hand covering member. The fluid reservoir unit is operatively secured to the top of the glove unit and in open fluid communication with the fluid delivery unit.

The fluid delivery unit comprises a fluid conduit member which is operatively associated with the glove unit and the fluid reservoir unit; wherein, the fluid flow through the fluid conduit member is controlled by a valve member.

In addition the polishing cloth unit comprises a layer of porous absorbent material that is dimensioned to conform to at least the bottom portion of the glove unit; wherein, the polishing unit further comprises securing means for operably and releasably attaching the layer of absorbent material to the glove unit.

When the glove apparatus of this invention is assembled the user does not have to worry about misplacing the source of fluid polish and the controlled delivery of the polish through the fluid delivery unit allows the user to selectively dispense the precise amount of polish for a particular task.

BRIEF DESCRIPTION OF THE DRAWINGS

These and other objects, advantages and novel features of the invention will become apparent from the detailed description of the best mode for carrying out the preferred embodiment of this invention which follows; particularly when considered in conjunction with the accompanying drawings, wherein:

FIG. 1 is a perspective view of the polishing glove apparatus;

FIG. 2 is a side plan view of the apparatus;

FIG. 3 is a top plan view;

FIG. 4 is an exploded perspective view; and,

FIG. 5 is an enlarged detailed cross-sectional view of the forward end of the apparatus.

BEST MODE FOR CARRYING OUT THE INVENTION

As can be seen by reference to the drawings and in particular to FIGS. 1 and 2, the polishing glove apparatus that forms the basis of the present invention is designated generally by the reference numeral (10). The apparatus (10) comprises in general a glove unit (11), a fluid reservoir unit (12), a fluid delivery unit (13) and a polishing cloth unit 14. These units will now be described in seriatim fashion.

As can best be seen by reference to FIGS. 1 through 3, the glove unit (11) comprises a waterproof hand covering member (15) such as a mitten (16) or a glove (not shown); wherein an enlarged web (17) is formed between the thumb (15') and finger (15'') portions of the hand covering member (15).

As shown in FIGS. 1 through 3 and 4 the fluid reservoir unit (12) comprises a reservoir member (18) that is operatively attached to the wrist portion (15'') of the hand covering member (15).

As can best be seen by reference to FIGS. 2 through 4, the fluid delivery unit (13) comprises a fluid conduit (20) which is operatively attached on one end to the hand covering member (15) in the vicinity of the web (17) wherein the other end of the fluid conduit (20) operatively secured to a fluid control member (21) which is in fluid communication with the contents of the fluid reservoir member (18); whereby, the fluid control member (21) governs the delivery of the fluid from the reservoir member (18) to the outlet end of the fluid conduit (20) in a well recognized manner.

Turning now to FIG. 4 it can be seen that the polishing cloth unit (14) comprises a layer of absorbent material (30) which is dimensioned to cover at least the bottom portion of the hand covering member (15); wherein, the layer of absorbent material (30) is further provided with securing means (31) such as a plurality of straps (32) for operably and releasably attaching the polishing cloth unit (14) to the glove unit.

It should further be noted that the layer of absorbent material (30) may also be dimensioned to substantially overlie the hand covering member (15) such that both the top and the bottom of the glove apparatus (10) may be used in the polishing process.

It should also be appreciated at this juncture that the glove apparatus of this invention permits controlled amounts of liquid polish to be delivered proximate the web (17) of the hand covering member (15) for application to the polishing cloth unit (14) and/or a surface to be polished.

Having thereby described the subject matter of the invention it should be apparent that many substitutions, modifications, and, variations of the invention are possible in light of the above teachings. It should therefore be understood that the invention as taught and defined herein is only to be limited to the extent of the breadth and scope of the appended claims.

I claim:

1. A glove apparatus for applying polish wherein the glove apparatus consists of:

a glove unit including a waterproof hand covering member including a wrist covering portion, a finger covering portion, a thumb covering portion, a first plurality of cooperating releasable securing means and a web formed between the thumb covering portion and the finger covering portion;

a reservoir unit for holding a liquid wherein second releasable securing means releasably secures the reservoir unit with the glove unit, said reservoir unit comprises a fluid reservoir member;

a fluid delivery unit including a fluid conduit having an inlet and an outlet and a fluid control member operatively connected to the fluid reservoir member wherein the fluid control member includes an outlet in communication with the inlet of the fluid conduit, the fluid control member controls the delivery of the contents of the fluid reservoir member to the fluid conduit; and, a polishing cloth unit comprising a layer of absorbent material which covers at least the bottom portion of the glove unit wherein the layer of absorbent material is provided with a second plurality of releasable cooperating securing means for operably engaging said first plurality of cooperable releasable securing means for attaching the polishing cloth unit to the glove unit; and, wherein said second releasable securing means includes a plurality of straps for releasably yet captively engaging the reservoir unit to the glove unit and the fluid conduit outlet is connected to the web on the glove unit at a location spaced from the end of the web.

* * * * *